US005501335A

United States Patent [19]

Harris

[11] Patent Number: 5,501,335

[45] Date of Patent: Mar. 26, 1996

[54] BANDED BASKET-STYLE CARRIER

[75] Inventor: Randall L. Harris, Powder Springs, Ga.

[73] Assignee: Riverwood International Corporation, Atlanta, Ga.

[21] Appl. No.: 310,123

[22] Filed: Sep. 21, 1994

[51] Int. Cl.[6] ..... B65D 75/00

[52] U.S. Cl. ..... 206/427; 206/200; 206/198; 206/192; 206/162; 229/117.24

[58] Field of Search ..... 206/192, 198, 206/200, 427, 428, 183, 162, 163; 229/117.19, 117.24

[56] References Cited

U.S. PATENT DOCUMENTS

| | | | |
|---|---|---|---|
| 2,162,235 | 6/1939 | Vaughn | 229/117.19 |
| 2,326,315 | 5/1943 | Turner | 229/117.24 |
| 2,345,746 | 4/1944 | Goodyear | 206/200 |
| 2,383,183 | 8/1945 | Fischer | 206/427 |
| 2,559,374 | 7/1951 | Ringler | 206/200 |
| 2,742,182 | 4/1956 | Hickin et al. | 206/200 |
| 2,864,531 | 12/1958 | Zastrow | 206/200 |
| 3,043,492 | 7/1962 | Stewart, Jr. | 229/117.24 |
| 3,955,745 | 5/1976 | Forrer | 206/428 |

*Primary Examiner*—Paul T. Sewell
*Assistant Examiner*—Marie Denise Patterson

[57] ABSTRACT

A basket-style carrier which exposes major portions of packaged articles to view. Short inwardly tapered side panels are connected by integral flexible bands which encircle the end articles in the carrier. A handle may connect opposite flexible bands or may be incorporated in a handle panel extending up through an opening in the bottom panel of the carrier. A transverse base panel connected to the handle panel contacts the bottom panel in face-to-face relationship.

15 Claims, 3 Drawing Sheets

BANDED BASKET-STYLE CARRIER

FIELD OF THE INVENTION

This invention relates to basket-style carriers. More particularly, it relates to a basket-style carrier having a minimum of structure so as to permit the packaged articles to be better viewed.

BACKGROUND OF THE INVENTION

The type of article carrier selected to package a particular product is usually a function of several different considerations. The carrier must be capable of supporting the articles in a manner which prevents them from falling out, the cost of the carrier cannot be excessive and the carrier design must be consistent with the packaging goal. For example, some products require a fully enclosed carrier in order to provide a secure package or to satisfy certain quality appearance standards. Fully enclosed packages provide maximum surface space for printing or graphics.

Other products are packaged in open-ended wrap-around carriers. While such carriers are less expensive, they provide less space for article-identifying indicia and are vulnerable to pricing errors. This arises from the practice of selling certain types of articles, such as food or beverage containers, either as individual units or in a multi-container carton. Each article is normally marked with a pricing code to enable it to be scanned and automatically totaled at a retail outlet when sold as an individual item. When packaged in conventional open-ended carriers, pricing errors can occur if the scanner sees the pricing code on one of the articles instead of the code on the package itself.

Some products, such as beverage bottles, are conventionally sold in basket-style carriers. Basket-style carriers are easy to carry and permit the top portions of the bottles to be seen. This is advantageous when the distinctive shape of the bottles or other packaged articles is suggestive of the brand. The unique shape of some articles is not limited to their top portions only but may include the shape of their lower portions, the type of overall surface configuration or the design of the bottom portion. In such cases it is desirable to use a package which exposes as much of the article as possible. This creates problems of carrier strength, since to expose the articles necessarily reduces the surface area of the carrier. It also creates pricing code problems similar to the problems discussed above.

It is an object of the invention to provide an article carrier which allows major portions of the articles to be exposed to view, but which provides adequate strength and is capable of covering the pricing code on the articles.

BRIEF SUMMARY OF THE INVENTION

A basket-style carrier for packaging two adjacent rows of articles includes a bottom panel and opposite side panels. Each side panel has an upper portion, a relatively wide lower portion and a relatively narrow intermediate portion. Flexible bands connected to and extending between opposite ends of the upper side panel portions snugly engage the end articles in the carrier. The open end portions between the flexible bands, the bottom panel and opposite intermediate side panel portions expose the lower portions of the end articles, while the relatively low side panels and bands allow the upper portions of the articles to be viewed. Preferably, each flexible band includes an end panel section and corner sections located between the end panel section and the upper side panel portions. Transverse fold lines are preferably included for defining the corner sections of the bands.

The carrier is adapted to be lifted by a handle. A particular handle design which reinforces the carrier as well as functioning as a handle is comprised of a handle panel extending upwardly from the bottom panel, preferably through a slot in the bottom panel. A transverse base on the handle panel engages the bottom panel and adds strength to the bottom panel.

The carrier is inexpensive to produce and simple to erect. It meets all the objectives of the invention, being capable of concealing the pricing code on the end articles, holding the articles tightly in place and exposing substantial portions of the articles to view. The features which enable the carrier to function in this manner are brought out in more detail in connection with the description of the preferred embodiments, wherein the above and other aspects of the invention, as well as other benefits, will readily become apparent.

DETAILED DESCRIPTION OF THE PREFERRED EMBODIMENTS

Figure 1:
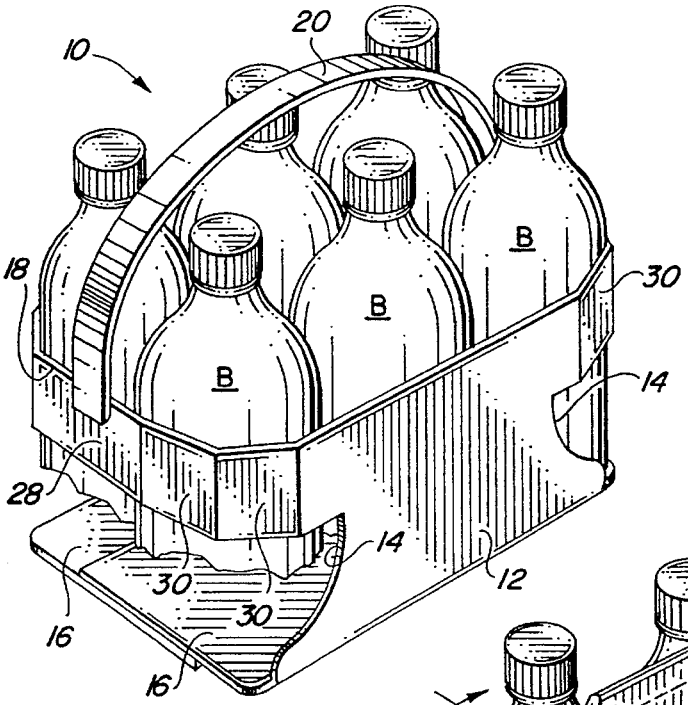
FIG. 1 is a pictorial view of one embodiment of the carrier of the invention, shown in connection with two rows of packaged bottles.

Referring to FIG. 1, a carrier 10 designed to hold six bottles B in two rows of three each is comprised of opposite side panels 12, the upper edges of which are located well below the necks of the bottles. The ends of the side panels are inwardly tapered to provide open cutaway areas 14 which expose the corners of the carrier. The side panels are connected to overlapping bottom panel flaps 16 which are adhered together, as by glue, to form the bottom panel of the carrier. In addition, flexible bands 18 connect the upper ends of the side panels to form end panel straps which encircle the end bottles in the carrier. Since the width of the band, as measured vertically, is minor compared to the height of the bottles, the end bottles are exposed to view to such an extent that their overall shape is readily distinguishable. The location and width of the bands not only allows most of the end bottles to be exposed to view, but also functions to cover the pricing code on the bottles. Because the band tightly fits about the bottles to firmly contain them, the bottles are prevented from individually rotating or swinging from the support panel when the package is carried. The carrier is easily lifted by the handle 20, which may take any desired form but in this case is illustrated as comprising a strap taped or otherwise adhered to the end bands 18.

Figure 2:
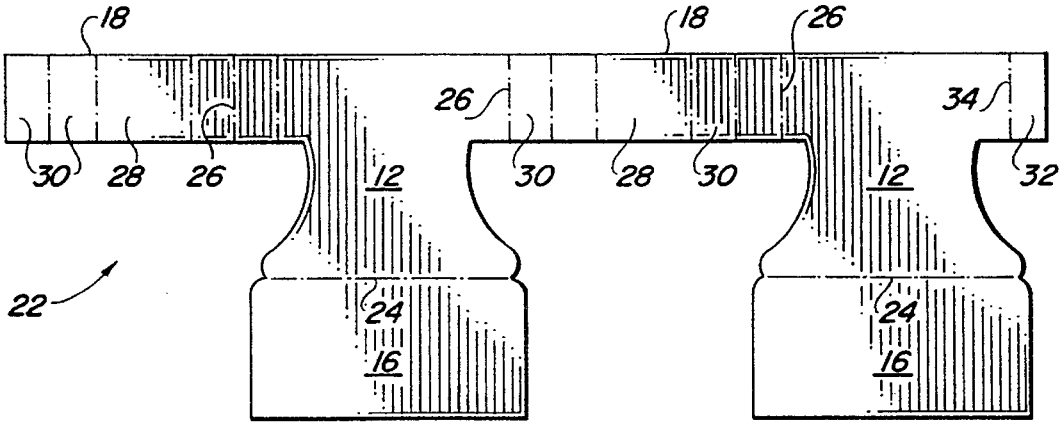
FIG. 2 is a plan view of a blank for forming the carrier of FIG. 1.

A blank 22 for forming the carrier body is shown in FIG. 2. It is preferably formed of paperboard, but may be of any suitable material having sufficient strength and flexibility to function in the manner of paperboard. The blank includes side panel sections 12 connected by fold lines 24 to the bottom panel flaps 16 and two band sections 18, one extending between the side panel sections and the other extending from the opposite end of the side panel section shown at the left of the drawing. Each band section includes fold lines 26 forming relatively large end panel sections 28 and smaller corner panel sections 30, the latter being arranged in pairs located between an end panel section and a side panel section. A glue flap 32 is connected by fold line 34 to the end of the side panel section shown at the right of the drawing.

To form a carrier from the blank 22, the glue flap 32 is adhered to the opposite end corner panel section 30 to form a continuous band, with the side panel sections positioned opposite each other as in the final carrier arrangement. The band section will fold as necessary about the fold lines 26 as the band section is moved into place. The bottom panel flaps 16 are then folded and glued in overlapping relationship. Because the inner circumference of the carrier is substantially equal to the outer circumference of the two rows of bottles B, insertion of the bottles into the carrier results in the side panels and the end bands tightly fitting about the bottles. The side panels and end panel sections 28 lie in planes forming substantially right angles with each other, with the corner band sections 30 fitting tightly about the corner bottles. Attachment of the handle 20 to the end band sections 28 completes the carrier.

As can be seen, the narrow band and the tapered shape of the side panels allows much of the end bottles to be seen, and the fact that the bottles extend up well above the top of the carrier allows the upper portions of the bottles to be exposed. In addition, the location of the band is such that the band covers the pricing code on the bottles. The carrier is especially useful in packaging nonfragile articles, such as plastic bottles, since provision need not be made for the carrier to include article separator sheets.

Figure 3:
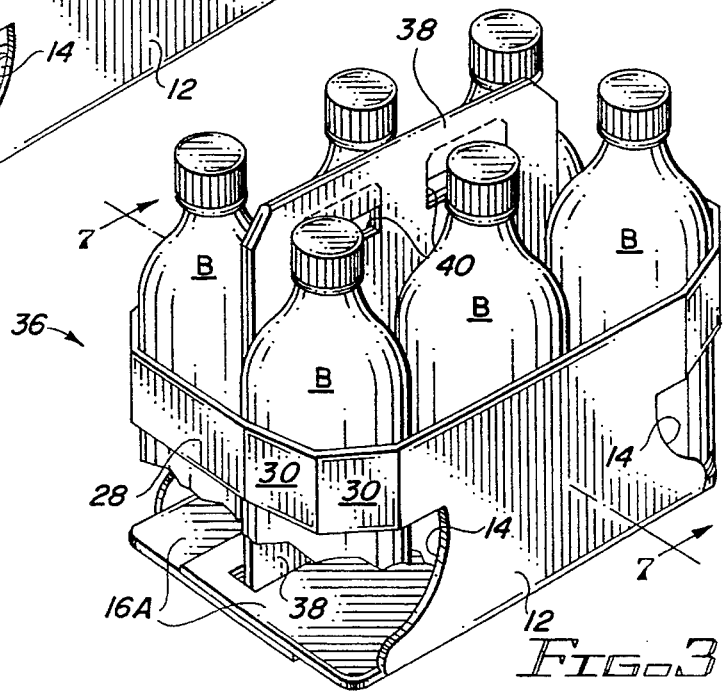
FIG. 3 is a pictorial view of another embodiment of the carrier of the invention.

Referring now to FIG. 3, another embodiment of the carrier is shown at 36. The main body of the carrier is substantially the same as the carrier of FIG. 1, except as noted below. The carrier includes a centrally located handle panel 38 extending up from the bottom panel between the two rows of bottles. The handle panel includes finger or hand openings 40 to facilitate lifting and further reinforces the carrier as will be made clear below.

Figure 4:
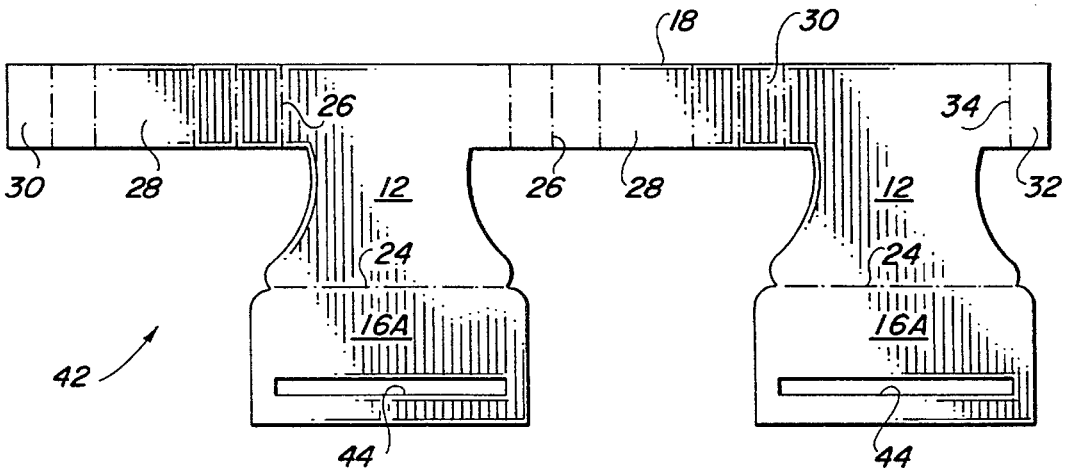
FIG. 4 is a plan view of a blank for forming the main body of the carrier of FIG. 3.
Figure 5:
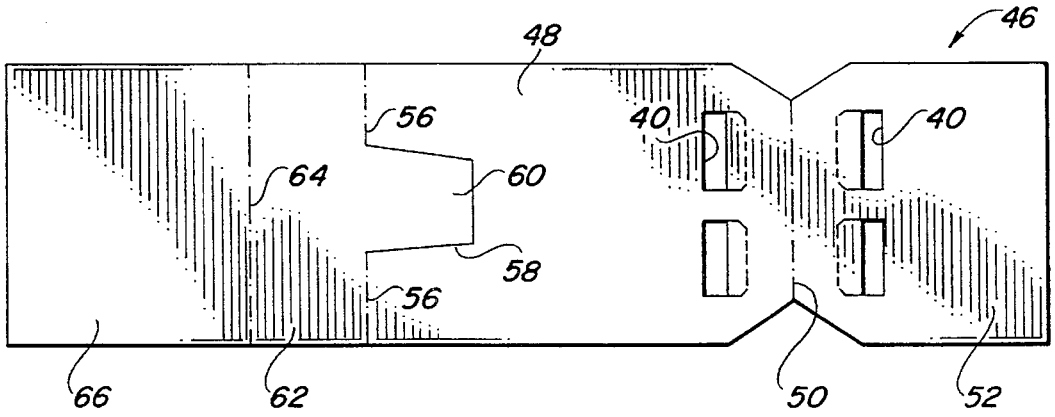
FIG. 5 is a plan view of a blank for forming the handle section for the carrier of FIG. 3.

The main body of the carrier 36 is formed from blank 42, shown in FIG. 4, which is identical to the blank 22 of FIG. 2 except for the inclusion of a slot 44 in each of the bottom panel flaps 16A. The handle panel is formed from blank 46, shown in FIG. 5. The handle panel blank includes a main body section 48 connected at one end by fold line 50 to a reinforcing flap 52. Handle openings 40 identical to the handle openings 40 in the main body section 48 are provided in the reinforcing flap 52 and are located so that the openings coincide when the flap is folded down. At the other end of the main body section 48 is a fold line 56 which is centrally interrupted by slit 58 defining a tab 60. The tab 60 is part of an upper bottom panel flap 62 which is connected by fold line 64 to a lower bottom panel flap 66.

Figure 6:
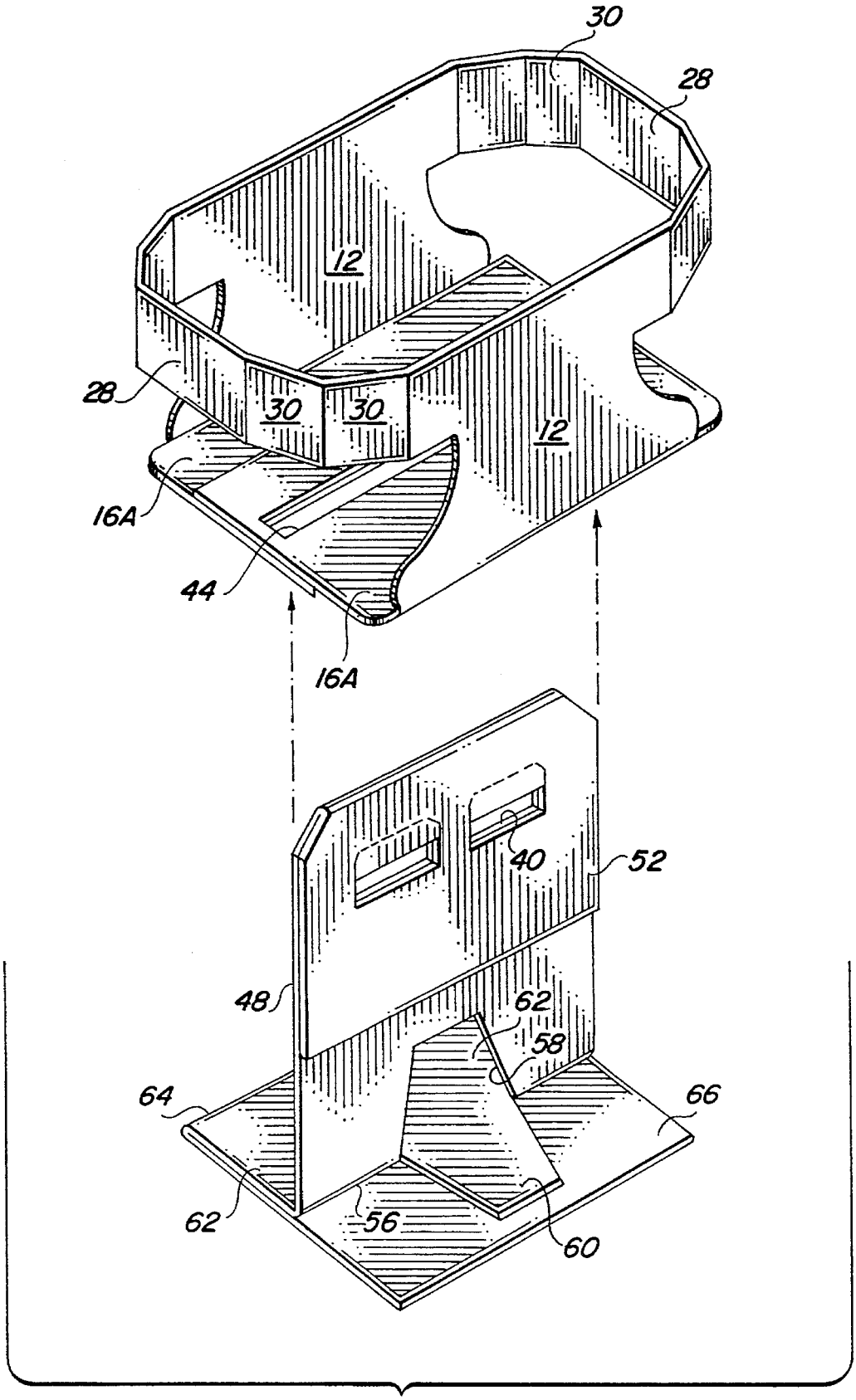
FIG. 6 is a pictorial view of the erected carrier blanks of FIGS. 4 and 5 in an initial stage of carrier formation.

To form the carrier of FIG. 3, the main body of the carrier is formed from the blank 42 in the same manner as the carrier of FIG. 1 is formed from the blank 22. In this case, however, the slots 44 in the bottom panel flaps 16A are located so as to be aligned in the bottom panel. The handle panel is separately formed from the blank 46 by folding the reinforcing flap 52 about the fold line 50 and gluing it to the main body section 48. The lower bottom panel flap 66 is folded about the fold line 64 and glued to the upper bottom panel flap 62. The adhered bottom panel flaps are then folded down about the fold line 56 to form a right angled base to the main handle panel body 48 as illustrated in FIG. 6. With the base folded out as in FIG. 6, the handle panel is inserted up through the slots 44 in the bottom panel of the carrier body until the upper faces of the handle panel flaps 62 and 66 contact the lower face of the bottom panel of the carrier body. One or more of these faces will have been coated with glue to adhere the handle panel base to the bottom panel of the carrier body.

Figure 7:
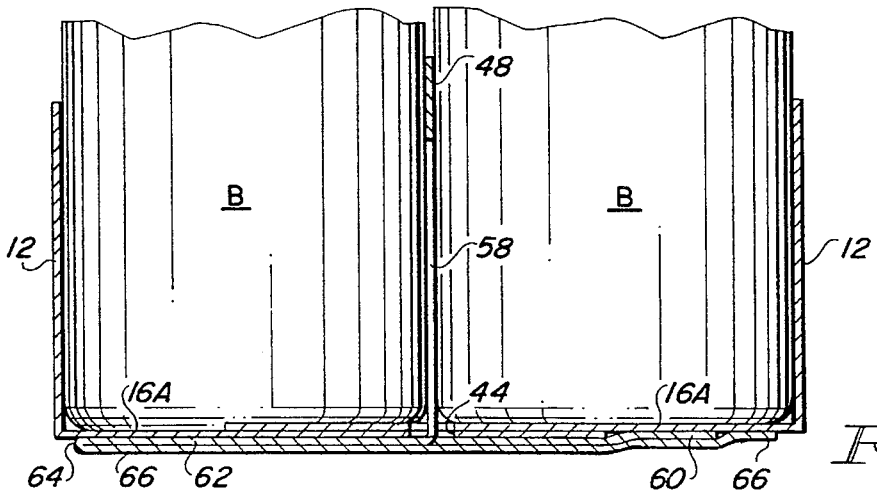
FIG. 7 is a sectional view taken on line 7—7 of FIG. 3.

As shown in FIG. 7, the combined handle panel flaps 62 and 66 and the bottom panel flaps 16 of the carrier body produce a four-ply bottom panel construction which is extremely strong and capable of supporting heavy loads without failure. The two-ply upper handle panel construction provides additional strength in the handle opening area where it is needed when lifting and carrying a heavy package. As in the first embodiment, this embodiment allows much of the end bottles and the upper portion of the middle bottles to be seen and effectively covers the pricing code on the bottles. The tight fit of the band and the side panels holds the bottles tightly in place, preventing them from swinging or rotating while the carrier is being lifted and carried.

It will be understood that the invention is not limited to all the specific details described in connection with the preferred embodiments, except as they may be within the scope of the appended claims. Changes to certain features of the preferred embodiment which do not alter the overall basic function and concept of the invention are therefore contemplated.

What is claimed is:

1. A basket-style carrier for packaging two adjacent rows of articles, comprising:

a bottom panel connected by fold lines to opposite side panels;

each side panel having an upper portion, a relatively wide lower portion and a relatively narrow intermediate portion between the upper and lower portions; and flexible bands connected to and extending between opposite ends of the upper side panel portions for snugly engaging articles packaged adjacent the flexible bands;

the carrier having open end portions between the flexible bands, the bottom panel and opposite intermediate side panel portions, whereby lower portions of articles packaged adjacent the flexible bands are exposed; and a handle connected to the carrier for lifting the carrier.

2. A basket-style carrier as defined in claim 1, wherein each flexible band includes an end panel section and corner sections located between the end panel section and the upper side panel portions.

3. A basket-style carrier as defined in claim 2, wherein each flexible band includes fold lines extending transversely of the width of the band, the transverse fold lines defining the corner sections of the bands.

4. A basket-style carrier as defined in claim 3, wherein the corner sections are defined by three spaced substantially vertical fold lines.

5. A basket-style carrier as defined in claim 1, wherein the handle is connected to and extends between opposite end panel sections.

6. A basket-style carrier as defined in claim 1, wherein the handle is comprised of openings in a handle panel extending upwardly from the bottom panel.

7. A basket-style carrier as defined in claim 6, wherein the handle panel extends upwardly through an opening in the bottom panel and is connected to the bottom panel.

8. A basket-style carrier as defined in claim 7, wherein the handle panel is connected to a transverse base panel, the transverse base panel being in face-to-face relationship with the bottom panel.

9. A basket-style carrier as defined in claim 8, wherein the bottom panel is comprised of overlapping bottom panel flaps, the opening in the bottom panel being comprised of aligned openings in the flaps.

10. A basket-style carrier containing two adjacent rows of articles, comprising:

a bottom panel connected by fold lines to opposite side panels;

each side panel having an upper portion, a relatively wide lower portion and a relatively narrow intermediate portion between the upper and lower portions; and flexible bands connected to and extending between opposite ends of the upper side panel portions, the flexible bands snugly engaging articles at the ends of the rows;

the carrier having open end portions between the flexible bands, the bottom panel and opposite intermediate side panel portions, whereby lower portions of the articles at the ends of the rows are exposed to view; and a handle connected to the carrier for lifting the carrier.

11. A basket-style carrier as defined in claim 10, wherein the articles extend up for a substantial distance above the flexible bands and the side panels.

12. A basket-style carrier as defined in claim 10, wherein each flexible band includes an end panel section and corner sections located between the end panel section and the upper side panel portions, each flexible band including fold lines extending transversely of the width of the band, the transverse fold lines defining the corner sections of the bands.

13. A basket-style carrier as defined in claim 12, wherein the corner sections are defined by three spaced substantially vertical fold lines.

14. A basket-style carrier as defined in claim 12, wherein the handle is connected to and extends between opposite end panel sections.

15. A basket-style carrier as defined in claim 12, wherein the handle is comprised of openings in a handle panel extending upwardly from the bottom panel.

* * * * *